US009851114B2

(12) United States Patent
Zinger et al.

(10) Patent No.: US 9,851,114 B2
(45) Date of Patent: Dec. 26, 2017

(54) HVAC SYSTEM WITH MULTIPURPOSE CABINET FOR AUXILIARY HEAT TRANSFER COMPONENTS

(75) Inventors: Leslie Zinger, Frankston, TX (US); Jeffrey L. Stewart, Whitehouse, TX (US)

(73) Assignee: Trane International Inc., Piscataway, NJ (US)

( * ) Notice: Subject to any disclaimer, the term of this patent is extended or adjusted under 35 U.S.C. 154(b) by 1139 days.

(21) Appl. No.: 13/027,803

(22) Filed: Feb. 15, 2011

(65) Prior Publication Data

US 2012/0205077 A1 Aug. 16, 2012

(51) Int. Cl.

| | |
|---|---|
| ***F28F 9/00*** | (2006.01) |
| ***F24F 5/00*** | (2006.01) |
| ***F24F 13/30*** | (2006.01) |
| *F24F 13/20* | (2006.01) |

(52) U.S. Cl.

CPC ..... *F24F 5/0071* (2013.01); *F24F 13/30* (2013.01); *F24F 13/20* (2013.01); *F24F 2221/34* (2013.01); *F24F 2221/36* (2013.01); *F28F 9/002* (2013.01); *F28F 2275/085* (2013.01); *F28F 2280/02* (2013.01)

(58) Field of Classification Search

CPC ..... F24F 211/34; F24F 211/36; F24F 13/20; F24F 13/30; F24F 2221/34; F24F 2221/36; F28F 9/002; F28F 2275/085; F28F 2280/02

USPC ..... 165/202–204, 42, 43, 48.1, 122, 76, 78, 165/137; 62/298; 454/121, 126, 160, 454/161

See application file for complete search history.

(56) References Cited

U.S. PATENT DOCUMENTS

| | | | | |
|---|---|---|---|---|
| 1,787,444 | A * | 1/1931 | French | 165/72 |
| 1,787,448 | A * | 1/1931 | Holton et al. | 165/74 |
| 1,841,361 | A * | 1/1932 | Bulkeley | 165/74 |
| 2,116,873 | A * | 5/1938 | Williams | F24F 13/20 454/231 |
| 2,282,373 | A * | 5/1942 | Minkler et al. | 165/137 |
| 2,615,687 | A * | 10/1952 | Simmons | 165/78 |

(Continued)

FOREIGN PATENT DOCUMENTS

| | | | |
|---|---|---|---|
| DE | 3916816 | A1 * | 5/1990 |
| EP | 1717071 | A1 * | 11/2006 |

(Continued)

OTHER PUBLICATIONS

Tsuji, JPH09133401Trans (English Translation), May 1997.*

(Continued)

*Primary Examiner* — Justin Jonaitis
*Assistant Examiner* — Eric Ruppert
(74) *Attorney, Agent, or Firm* — Conley Rose, P.C.; J. Robert Brown, Jr.

(57) ABSTRACT

An HVAC system having an airflow path, a primary heat exchanger disposed along the airflow path, wherein the airflow path at least partially passes through the primary heat exchanger, and a multipurpose cabinet selectively configurable between at least a first configuration for housing a first type of auxiliary heat transfer component and a second configuration for housing a second type of auxiliary heat transfer component, wherein the airflow path at least partially passes through the multipurpose cabinet.

7 Claims, 14 Drawing Sheets

(56) References Cited

U.S. PATENT DOCUMENTS

| | | | | | |
|---|---|---|---|---|---|
| 3,012,762 | A | * | 12/1961 | Norris | 165/48.1 |
| 3,089,315 | A | * | 5/1963 | Brandt | 165/137 |
| 3,098,145 | A | * | 7/1963 | Raymond | 165/48.1 |
| 3,545,424 | A | | 12/1970 | Lohman | |
| 3,631,525 | A | * | 12/1971 | Brasch | 392/350 |
| 3,734,171 | A | * | 5/1973 | Ares et al. | 392/350 |
| 3,977,467 | A | * | 8/1976 | Northrup, Jr. | 165/137 |
| 4,072,187 | A | * | 2/1978 | Lodge | 165/48.1 |
| 4,328,859 | A | * | 5/1982 | Bouvot | B60H 1/00328 165/149 |
| 4,495,986 | A | * | 1/1985 | Clark et al. | 165/216 |
| 4,974,551 | A | | 12/1990 | Nelson | |
| 5,203,500 | A | | 4/1993 | Horne, Sr. | |
| 5,217,405 | A | * | 6/1993 | Tanaka | 454/121 |
| 5,277,036 | A | * | 1/1994 | Dieckmann et al. | 165/76 |
| 5,538,072 | A | | 7/1996 | Burkhart et al. | |
| 5,967,411 | A | | 10/1999 | Perry et al. | |
| 6,149,066 | A | | 11/2000 | Perry et al. | |
| 6,233,958 | B1 | | 5/2001 | Mei et al. | |
| 7,601,204 | B2 | | 10/2009 | Woodruff et al. | |
| 2012/0085334 | A1 | * | 4/2012 | Beck | F24H 9/02 126/114 |

FOREIGN PATENT DOCUMENTS

| | | | | | |
|---|---|---|---|---|---|
| FR | 2783465 | A1 | * | 3/2000 | |
| IT | WO 2005064259 | A1 | * | 7/2005 | F24H 1/40 |
| JP | 04108026 | A | * | 4/1992 | |
| JP | H09133401 | | * | 5/1997 | |
| JP | 2002219929 | A | * | 8/2002 | |

OTHER PUBLICATIONS

Canadian Office Action; Application No. 2,766,754 dated Oct. 4, 2013; 2 pages.

Canadian Office Action; Application No. 2,766,754 dated Jul. 21, 2014; 2 pages.

* cited by examiner

HVAC SYSTEM WITH MULTIPURPOSE CABINET FOR AUXILIARY HEAT TRANSFER COMPONENTS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and air conditioning systems (HVAC systems) sometimes comprise an auxiliary heat transfer component (AHTC). An AHTC may be configured to provide a heating effect, a cooling effect, or both. In some embodiments, an AHTC may be disposed within a so-called "air handling unit" (hereinafter referred to as an "AHU") that may comprise a primary heat exchanger (hereinafter referred to as a PHE) and one or more fans and/or blowers configured to selectively force air through the AHTC and/or the PHE of an HVAC system for delivery into a building or space to be conditioned by the HVAC system.

SUMMARY OF THE DISCLOSURE

In some embodiments of the disclosure, an HVAC system is provided that comprises an airflow path, a primary heat exchanger disposed along the airflow path, wherein the airflow path at least partially passes through the primary heat exchanger, and a multipurpose cabinet selectively configurable between at least a first configuration for housing a first type of auxiliary heat transfer component and a second configuration for housing a second type of auxiliary heat transfer component, wherein the airflow path at least partially passes through the multipurpose cabinet.

In other embodiments of the disclosure, a multipurpose cabinet for an HVAC system is provided that comprises a plurality of walls, at least one backing plate, and a front cover. In some embodiments, the plurality of walls and the front cover are configurable to be joined together to at least partially envelope a space the multipurpose cabinet comprises a first configuration for housing at least a portion of a first type of auxiliary heat exchange component within the space and wherein the multipurpose cabinet comprises a second configuration for, to the exclusion of the first type of auxiliary heat exchange component, housing at least a portion of a second type of auxiliary heat exchange component within the space.

In still other embodiments of the disclosure, an air handling unit for an HVAC system is provided that comprises a blower cabinet, a blower at least partially carried within the blower cabinet, a primary heat exchanger cabinet, a primary heat exchanger at least partially carried within the primary heat exchanger cabinet, and a multipurpose cabinet comprising a first configuration for housing at least a portion of a first type of auxiliary heat exchange component within the multipurpose cabinet and a second configuration for, to the exclusion of the first type of auxiliary heat exchange component, housing at least a portion of a second type of auxiliary heat exchange component within the multipurpose cabinet.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Figure 1:
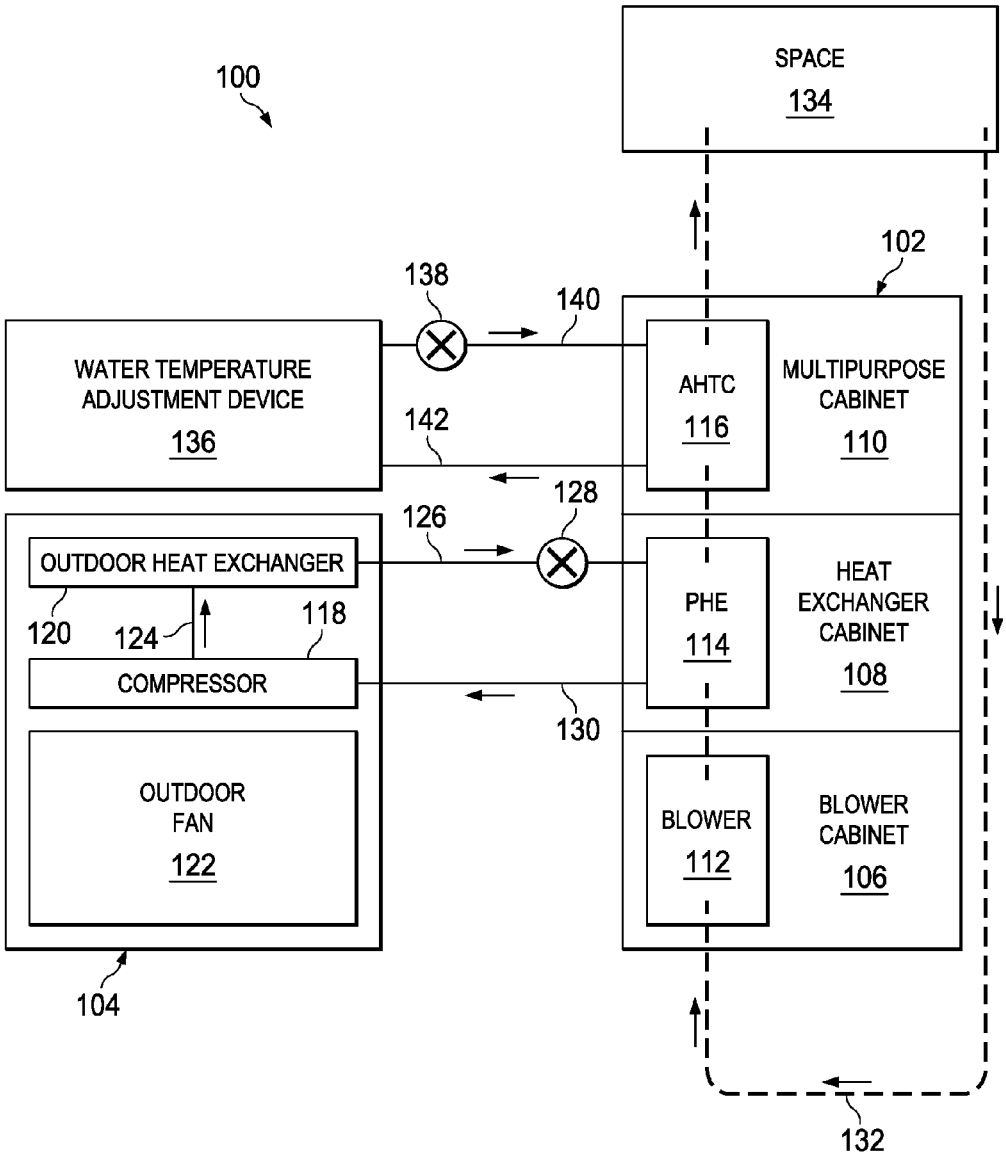
FIG. 1 is a schematic view of an HVAC system comprising a multipurpose cabinet for an AHTC according to an embodiment of the disclosure.

HVAC systems may comprise an auxiliary heat transfer component (AHTC) in addition to a primary heat exchanger (PHE). In some embodiments, the AHTC may be configured for use in the case of failure of a PHE. In other embodiments, an AHTC may be configured for use in concert with a PHE to provide the HVAC system with supplemental heat transfer capacity. For example, when a heating PHE, such as a furnace, is used in combination with a heating AHTC, the total heating capacity of the HVAC system may comprise at least the sum of the heating capacities of the heating AHTC and the heating PHE. Similarly, when a cooling PHE, such as an evaporator coil, is used in combination with a cooling AHTC, the total cooling capacity of the HVAC system may comprise at least the sum of the cooling capacities of the cooling AHTC and the cooling PHE.

In other embodiments of an HVAC system, an AHTC may be configured for simultaneous use with a PHE to provide the HVAC system an improved ability to more accurately deliver a desired rate of heat transfer and/or to deliver air to a conditioned space at a selected temperature with greater control. For example, because a cooling PHE may cool air to a temperature below a desired delivery temperature, a heating AHTC may be used to warm the air so that a selected delivery temperature may be achieved. Similarly, because a heating PHE may heat air to a temperature above a desired delivery temperature, a cooling AHTC may be used to cool the air so that a selected delivery temperature may be achieved.

In some embodiments, a single PHE may selectively provide heating or cooling, as may be the case of a heat exchanger of a so-called heat pump system. Similarly, an AHTC may selectively provide heating or cooling, as may be the case of a hydronic heat exchanger (HHE) which primarily uses heated or cooled water as a heat transfer medium. In other embodiments, an AHTC may comprise one or more resistive electrical heat elements (REHE) that are configured to generate heat by converting electrical energy into heat energy.

While some embodiments of an REHE may generate temperatures of about 160° F. or above, an HHE may generate temperatures that typically do not exceed 180° F. Further, while an REHE requires a supply of electrical energy and associated electrical switching components, an HHE, in some cases, may require only a water input line and a water output line. As described above, the operating conditions and structural requirements of various types of AHTCs may be different. Those differences may lead to undesirably high manufacturing costs and/or inefficiencies related to manufacturing multiple types of AHTC enclosure models and/or AHTC cabinet models suitable for housing the various types of AHTCs.

There is a need for an HVAC system comprising a cabinet that is suitable for use with multiple types of AHTCs. Accordingly, the present disclosure provides systems and methods for safely and effectively housing various types of AHTCs within a so-called "multipurpose cabinet" for AHTCs. In some embodiments, a multipurpose cabinet may comprise materials and other features to safely house an REHE and its required electrical connections while also being configured to alternatively safely house an HHE and its required water input line and water output line, the multipurpose cabinet being generally configured to house one type of AHTC at any one time. In some embodiments, the multipurpose cabinet may comprise features provided to allow easy insertion and/or removal of a plurality of types of AHTCs. For example, in some embodiments, a multipurpose cabinet may comprise features well suited for allowing easy insertion, removal, and/or housing an REHE when the multipurpose cabinet is arranged in a first configuration and alternatively well suited for allowing easy insertion, removal, and/or housing an HHE when the multipurpose cabinet is arranged in a second configuration. In some embodiments, the multipurpose cabinet may be formed integrally with an AHU. In some embodiments, the multipurpose cabinet may be removable from an AHU in a modular and/or quick-connect manner. In some embodiments, the multipurpose cabinet may be configured for installation remote from an AHU and may be configured for insertion along an airflow path of an HVAC system that is downstream or upstream of an AHU.

FIG. 1 shows an HVAC system 100 according to an embodiment of this disclosure. The HVAC system 100 comprises an AHU (sometimes referred to as an indoor unit) 102 and an outdoor unit (sometimes referred to as a condensing unit) 104. In this embodiment, the AHU 102 may be conceptualized as comprising a plurality of cabinet portions. Particularly, the AHU 102 may be conceptualized as comprising a blower cabinet 106, a primary heat exchanger cabinet 108, and a multipurpose cabinet 110. In some embodiments, the cabinet portions of the AHU 102 may be formed integrally as a single unit. In other embodiments, one or more of the cabinet portions of the AHU 102 may be formed in a modular manner so that the cabinet portions may selectively be joined to each other and/or removed from each other in a so-called quick-connect manner or other convenient manner. In this embodiment, the blower cabinet 106 is configured to house a blower 112, the primary heat exchanger cabinet 108 is configured to house a PHE 114, and the multipurpose cabinet 110 is configurable to house at least two different types of AHTCs. In some embodiments, the blower 112 may comprise a centrifugal fan, a mixed-flow type fan, a radial fan, and/or any other suitable air moving device. In some embodiments, the PHE 114 may comprise a fin and tube type refrigerant heat exchanger and may be referred to as a so-called evaporator coil. In some embodiments, the multipurpose cabinet 110 may be selectively configurable to house an REHE and a HHE, in most embodiments only one at a time. For example, the multipurpose cabinet is shown in FIG. 1 as being configured in a first configuration to house an AHTC 116 comprising a HHE. The same multipurpose cabinet 110 shown in FIG. 1 may selectively be configured to alternatively house an AHTC comprising an REHE.

The outdoor unit 104 comprises a compressor 118, an outdoor heat exchanger (sometimes referred to as a condenser coil) 120, and an outdoor fan 122. In operation of the compressor 118 to provide a cooling effect, refrigerant may be compressed by the compressor 118 and pumped through a discharge line 124 to the outdoor heat exchanger 120. The outdoor fan 122 may be operated to cool the refrigerant passing through the outdoor heat exchanger 120 and the refrigerant may be passed through a liquid line 126 to the primary heat exchanger 114. Prior to reaching the PHE 114, the refrigerant may be passed through a refrigerant expansion device 128 which results in a cooling of the refrigerant. The refrigerant may be returned to the compressor 118 through a suction line 130. The cooled refrigerant cools the PHE 114 and the blower 112 may be operated to move air along an airflow path 132. The airflow path 132, in some embodiments, at least partially originates and at least partially terminates in a space 134 conditioned by the HVAC system 100. Most generally, the airflow path 132 may be configured to pass through the AHU 102 so that the air following the airflow path 132 may be selectively conditioned by the PHE 114 and/or the AHTC 116. Of course, in alternative embodiments, such as, but not limited to, heat pump HVAC systems, an HVAC system 100 may be configured differently from the manner shown in FIG. 1 in order to provide heating and/or cooling of air delivered to the space 134.

In some embodiments, the HVAC system 100 may further comprise a water temperature adjustment device 136. The water temperature adjustment device 136 may comprise a boiler, a water chiller refrigeration system, and/or any other suitable component for selectively adjusting the temperature of water. In some embodiments, the temperature of water may be adjusted by the water temperature adjustment device 136 and the water may thereafter be forced by a pump 138 from the water temperature adjustment device 136 to the AHTC 116 through an inlet line 140. During operation of the blower 112, air may interact with the AHTC 116 in a manner that results in an adjustment of the air temperature prior to delivering the air to the space 134. In some embodiments, water may be returned to the water temperature adjustment device 136 via an outlet line 142.

It will be appreciated that in cases where the multipurpose cabinet 110 may be configured in a second configuration to house an AHTC 116 comprising an REHE, the HVAC system 100 may not comprise one or more of the above-described water temperature adjustment device 136, pump 138, inlet line 140, and outlet line 142. Instead, the HVAC system may further comprise electrical switches and electrical power supply wires routed to the AHTC 116 to selectively power the REHE.

The AHU 102 is referred to as a so-called blow-through AHU 102 because the blower 112 may be located upstream along the airflow path 132 relative to the PHE 114. In this embodiment, the multipurpose cabinet 110 is located adjacent the primary heat exchanger cabinet 108 and downstream relative to both the primary heat exchanger cabinet 108 and the blower cabinet 106.

Figure 2:
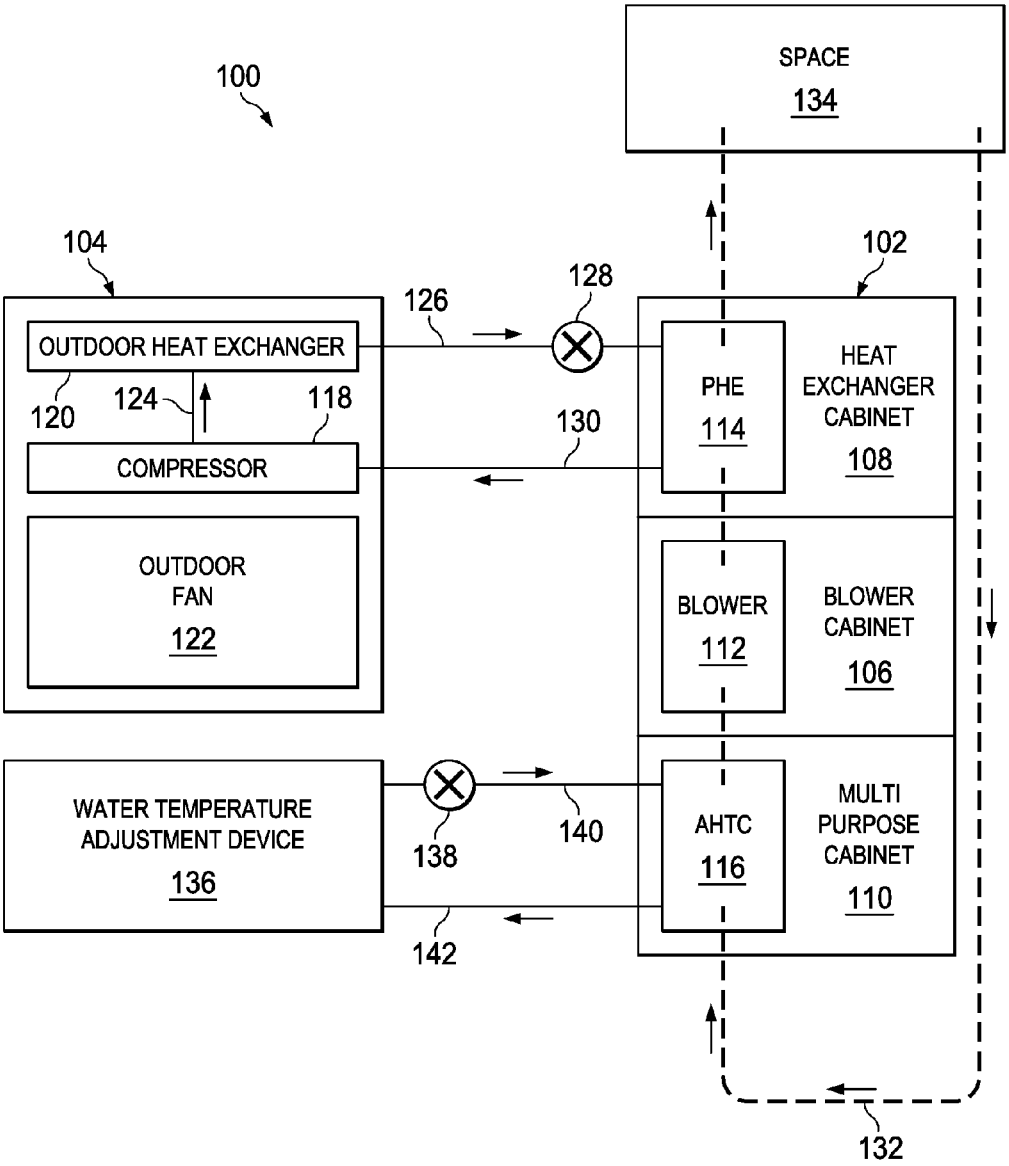
FIG. 2 is a schematic view of an HVAC system comprising a multipurpose cabinet for an AHTC according to another embodiment of the disclosure.

Referring now to FIG. 2, an HVAC system 100 is shown in an alternative configuration. In this embodiment, the AHU 102 may be referred to as a so-called blow-through AHU 102 because the blower 112 is located upstream along the airflow path 132 relative to the PHE 114. In this embodiment, the multipurpose cabinet 110 is located adjacent the blower cabinet 106 and upstream relative to both the primary heat exchanger cabinet 108 and the blower cabinet 106.

Figure 3:
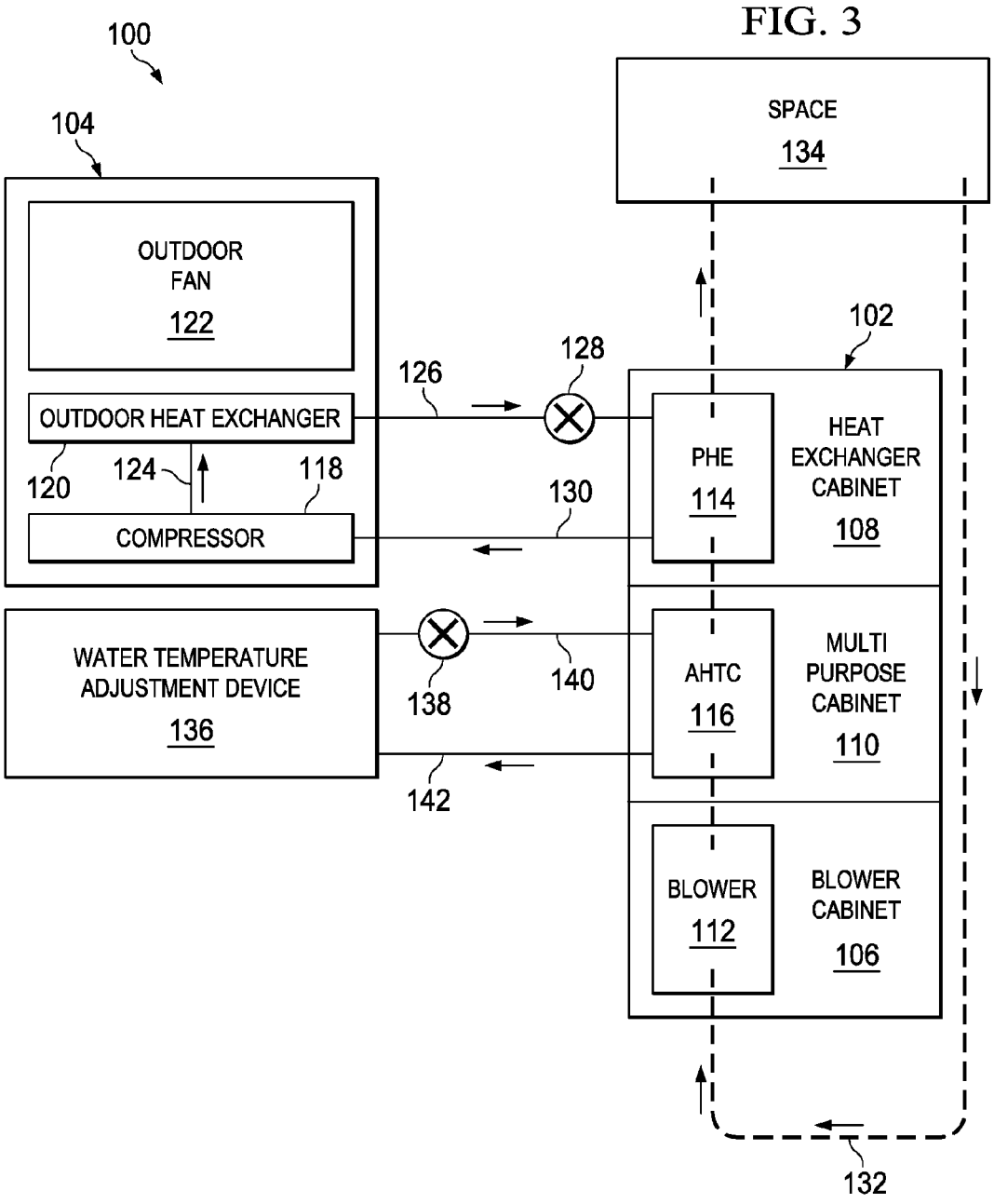
FIG. 3 is a schematic view of an HVAC system comprising a multipurpose cabinet for an AHTC according to another embodiment of the disclosure.

Referring now to FIG. 3, an HVAC system 100 is shown in an alternative configuration. In this embodiment, the AHU 102 may be referred to as a so-called blow-through AHU 102 because the blower 112 is located upstream along the airflow path 132 relative to the PHE 114. In this embodiment, the multipurpose cabinet 110 is located between the blower cabinet 106 and the primary heat exchanger cabinet 108. The multipurpose cabinet 110 is located downstream relative to the blower cabinet 106 and upstream relative to the primary heat exchanger cabinet 108.

Figure 4:
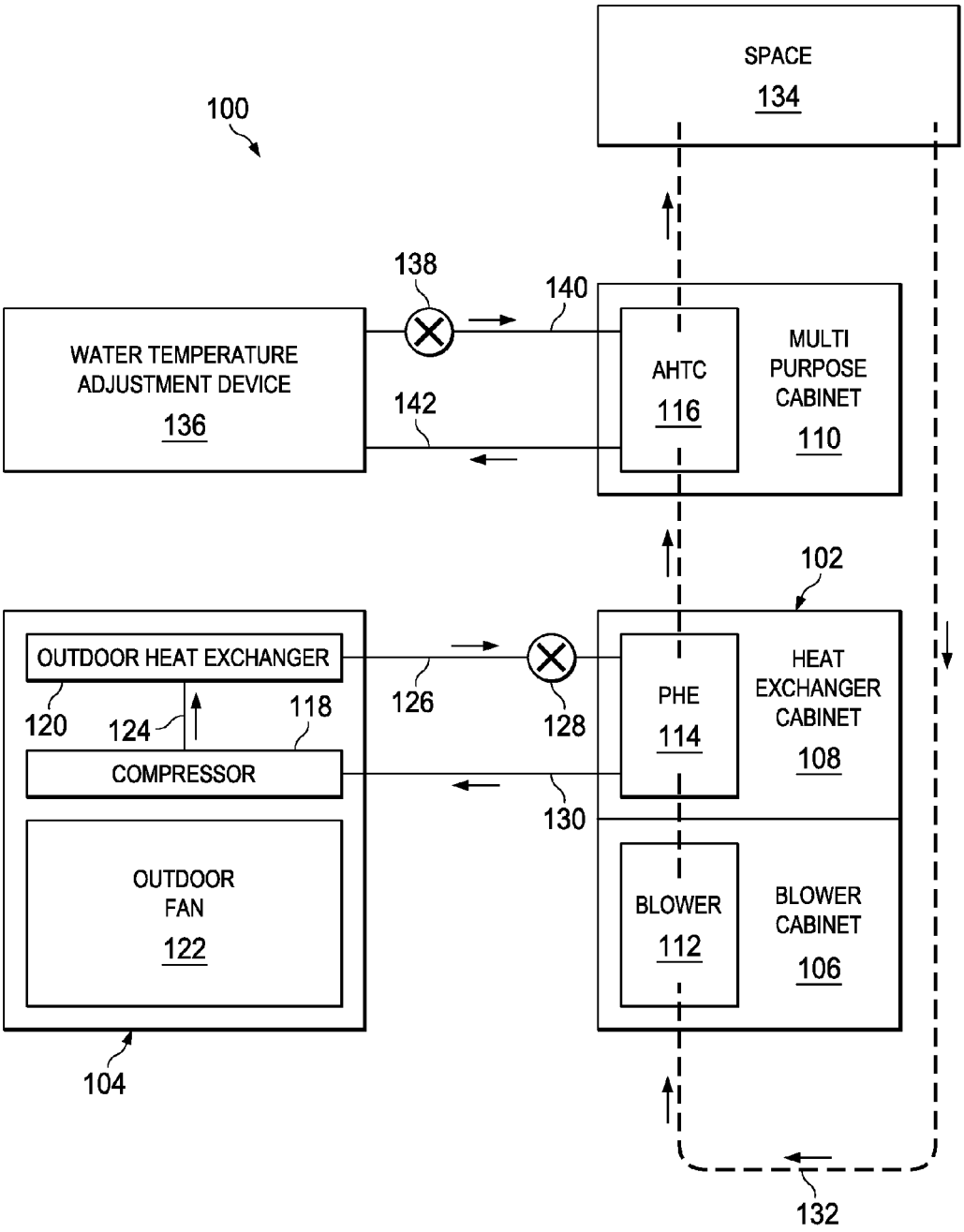
FIG. 4 is a schematic view of an HVAC system comprising a multipurpose cabinet for an AHTC according to another embodiment of the disclosure.

Referring now to FIG. 4, an HVAC system 100 is shown in an alternative configuration. The HVAC system 100 of FIG. 4 may be configured substantially the same as the HVAC system of FIG. 1 except that the multipurpose cabinet 110 is not integral with the AHU 102. Instead, the multipurpose cabinet 110 is remote from the AHU 102 and is located downstream relative to the AHU 102.

Figure 5:
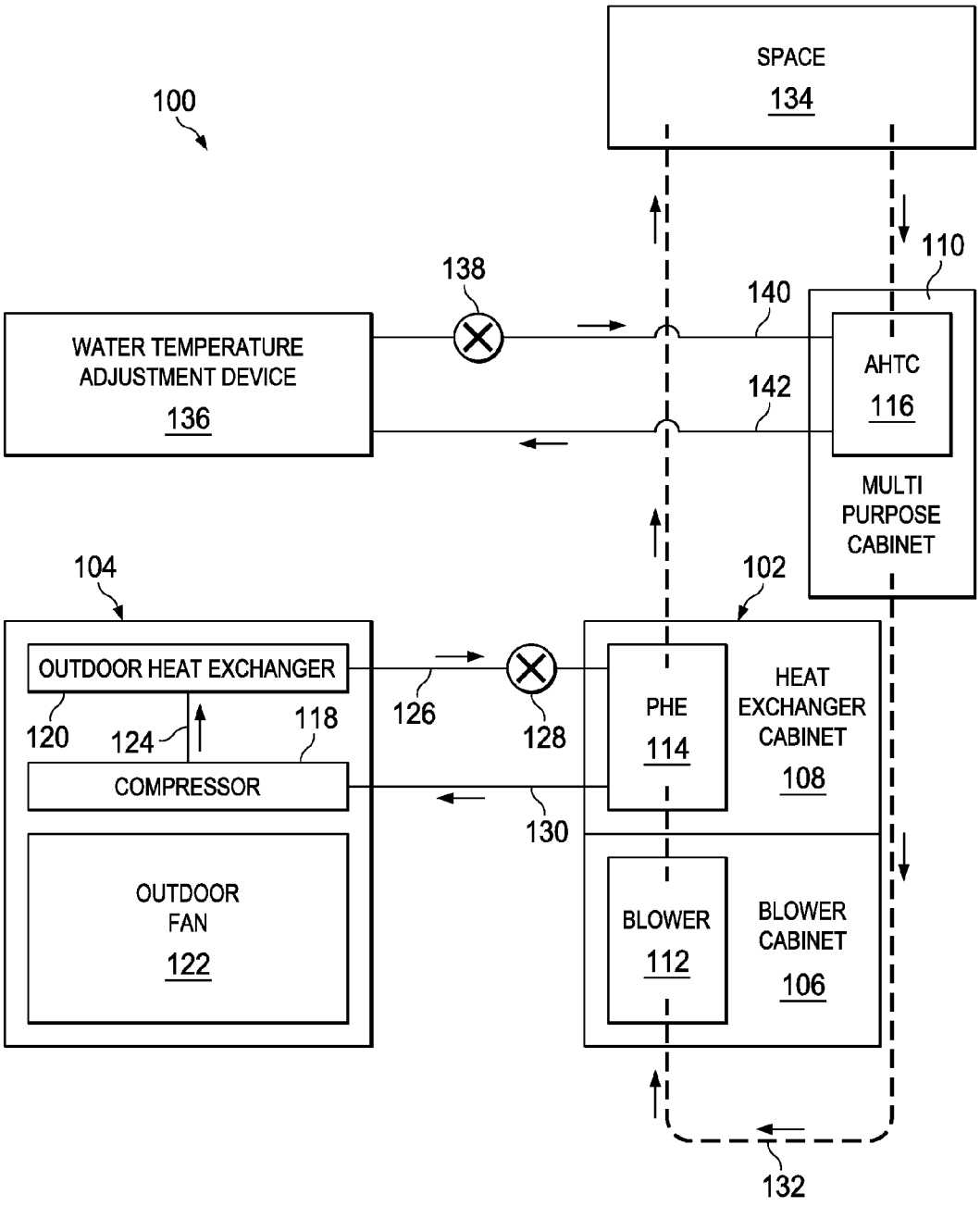
FIG. 5 is a schematic view of an HVAC system comprising a multipurpose cabinet for an AHTC according to another embodiment of the disclosure.

Referring now to FIG. 5, an HVAC system 100 is shown in an alternative configuration. The HVAC system 100 of FIG. 4 may be configured substantially the same as the HVAC system of FIG. 2 except that the multipurpose cabinet 110 is not integral with the AHU 102. Instead, the multipurpose cabinet 110 is remote from the AHU 102 and is located upstream relative to the AHU 102.

Figure 6:
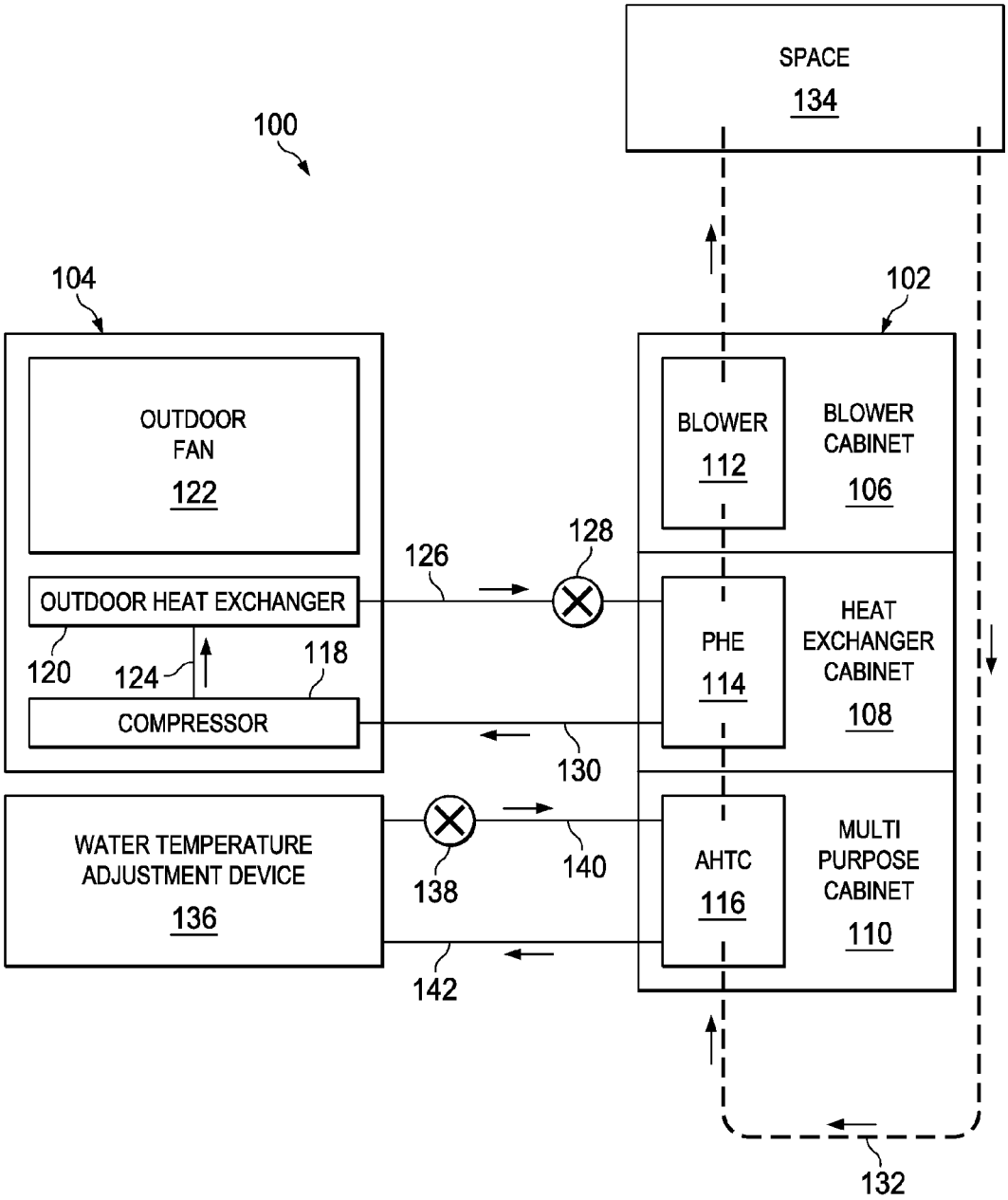
FIG. 6 is a schematic view of an HVAC system comprising a multipurpose cabinet for an AHTC according to another embodiment of the disclosure.

Referring now to FIG. 6, an HVAC system 100 is shown in an alternative configuration. In this embodiment, the AHU 102 may be referred to as a so-called draw-through AHU 102 because the blower 112 is located downstream along the airflow path 132 relative to the primary heat exchanger cabinet 108. In this embodiment, the multipurpose cabinet 110 is located adjacent primary heat exchanger cabinet 108 and upstream relative to both the primary heat exchanger cabinet 108 and the blower cabinet 106.

Figure 7:
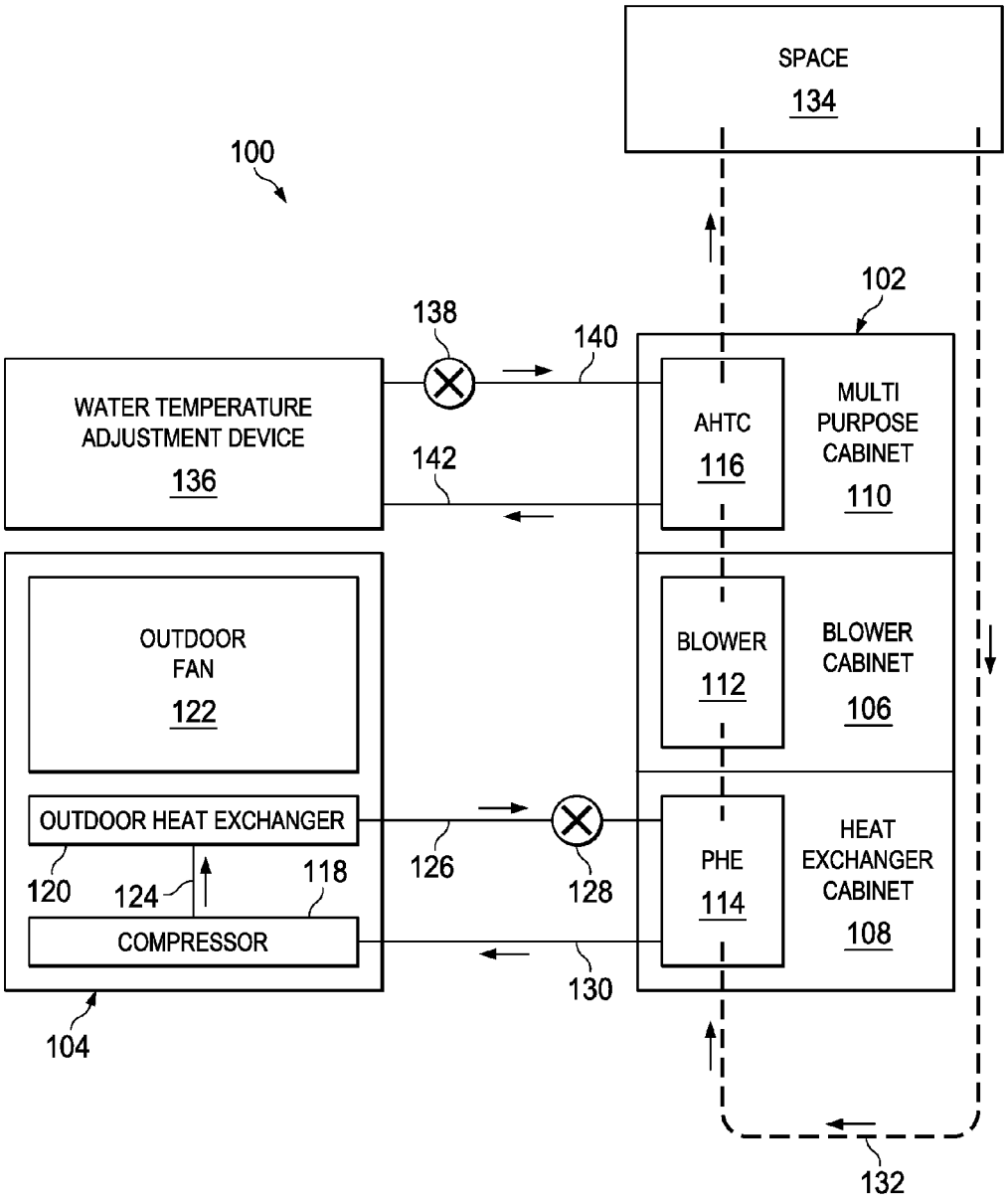
FIG. 7 is a schematic view of an HVAC system comprising a multipurpose cabinet for an AHTC according to another embodiment of the disclosure.

Referring now to FIG. 7, an HVAC system 100 is shown in an alternative configuration. In this embodiment, the AHU 102 may be referred to as a so-called draw-through AHU 102 because the blower 112 is located downstream along the airflow path 132 relative to the primary heat exchanger cabinet 108. In this embodiment, the multipurpose cabinet 100 is located adjacent the blower cabinet 106 and downstream relative to both the blower cabinet 106 and the primary heat exchanger cabinet 108.

Figure 8:
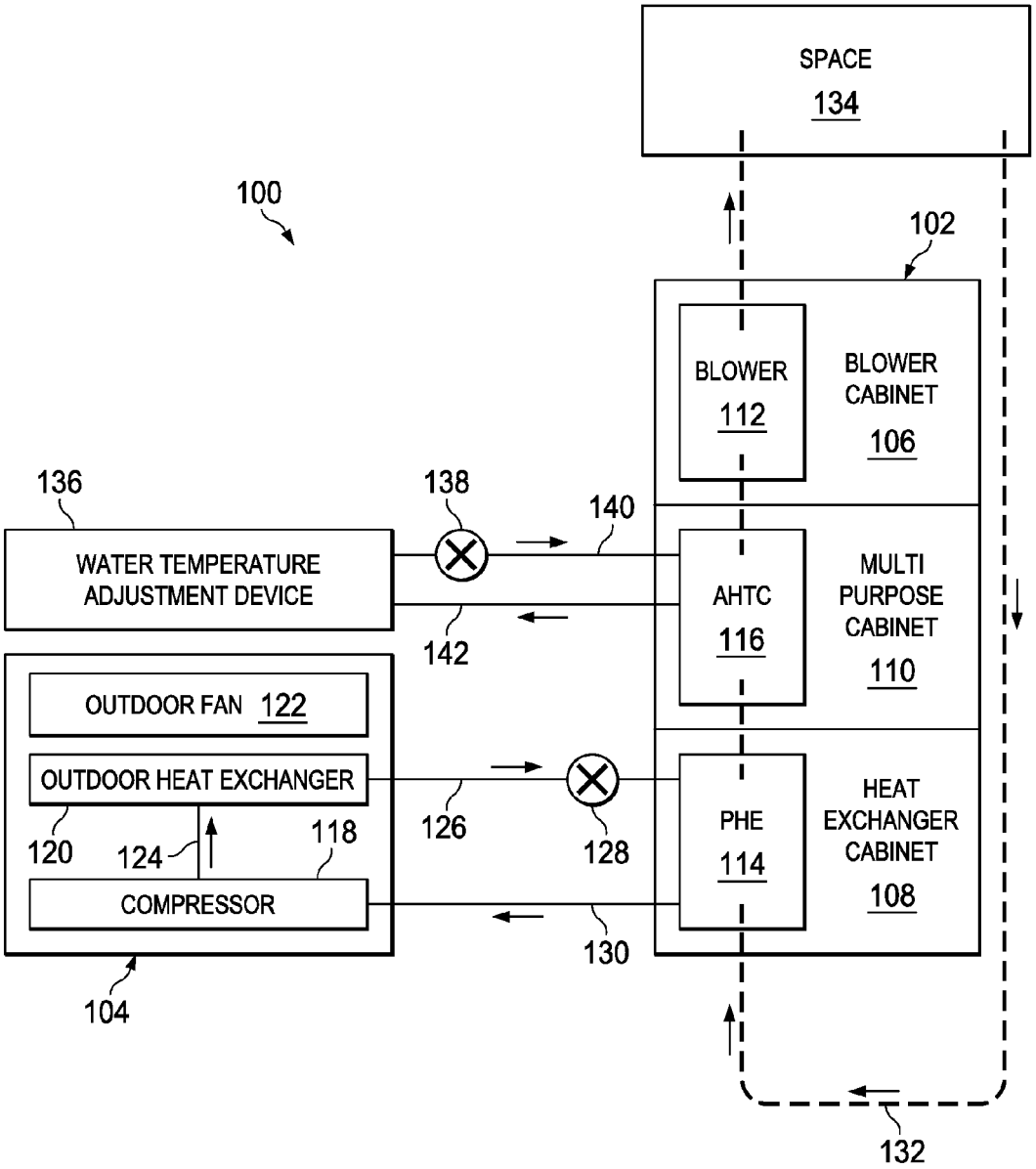
FIG. 8 is a schematic view of an HVAC system comprising a multipurpose cabinet for an AHTC according to another embodiment of the disclosure.

Referring now to FIG. 8, an HVAC system 100 is shown in an alternative configuration. In this embodiment, the AHU 102 may be referred to as a so-called draw-through AHU 102 because the blower 112 is located downstream along the airflow path 132 relative to the primary heat exchanger cabinet 108. In this embodiment, the multipurpose cabinet 110 is located between the blower cabinet 106 and the primary heat exchanger cabinet 108. The multipurpose cabinet 110 is located downstream relative to the primary heat exchanger cabinet 108 and upstream relative to the blower cabinet 106.

Figure 9:
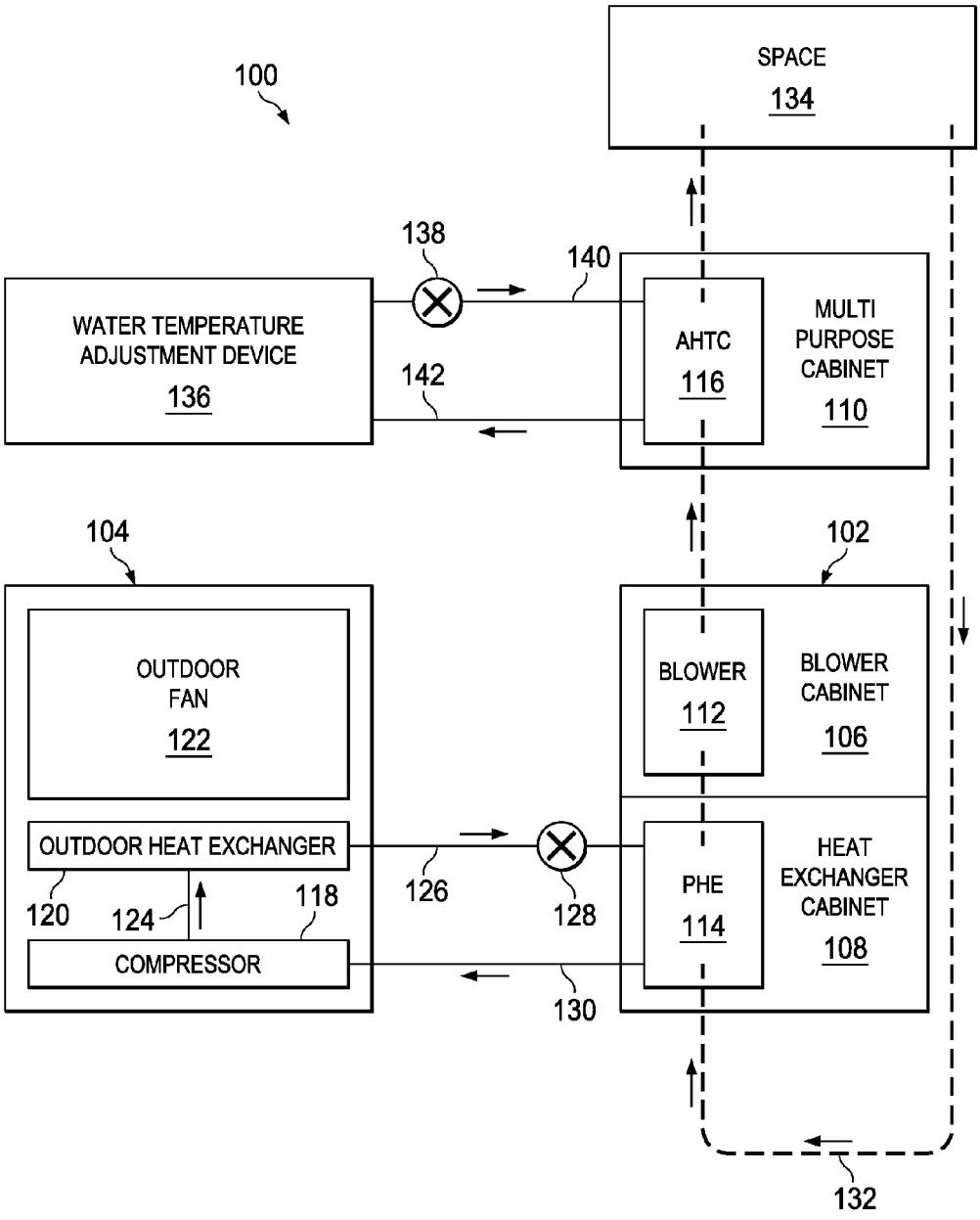
FIG. 9 is a schematic view of an HVAC system comprising a multipurpose cabinet for an AHTC according to another embodiment of the disclosure.

Referring now to FIG. 9, an HVAC system 100 is shown in an alternative configuration. The HVAC system 100 of FIG. 9 may be configured substantially the same as the HVAC system of FIG. 7 except that the multipurpose cabinet 110 is not integral with the AHU 102. Instead, the multipurpose cabinet 110 is remote from the AHU 102 and is located downstream relative to the AHU 102.

Figure 10:
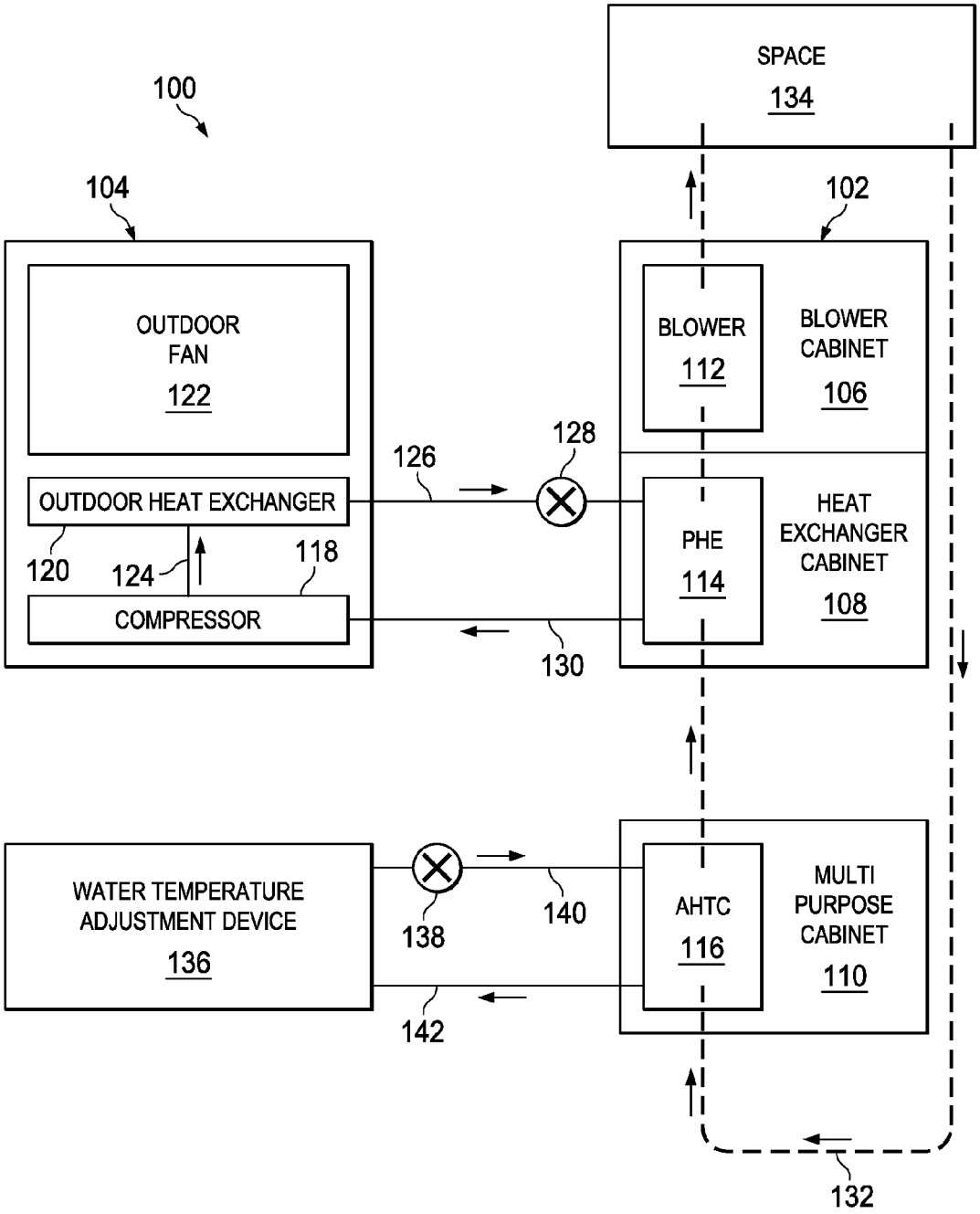
FIG. 10 is a schematic view of an HVAC system comprising a multipurpose cabinet for an AHTC according to another embodiment of the disclosure.

Referring now to FIG. 10, an HVAC system 100 is shown in an alternative configuration. The HVAC system 100 of FIG. 10 may be configured substantially the same as the HVAC system of FIG. 6 except that the multipurpose cabinet 110 is not integral with the AHU 102. Instead, the multipurpose cabinet 110 is remote from the AHU 102 and is located upstream relative to the AHU 102.

Figure 11:
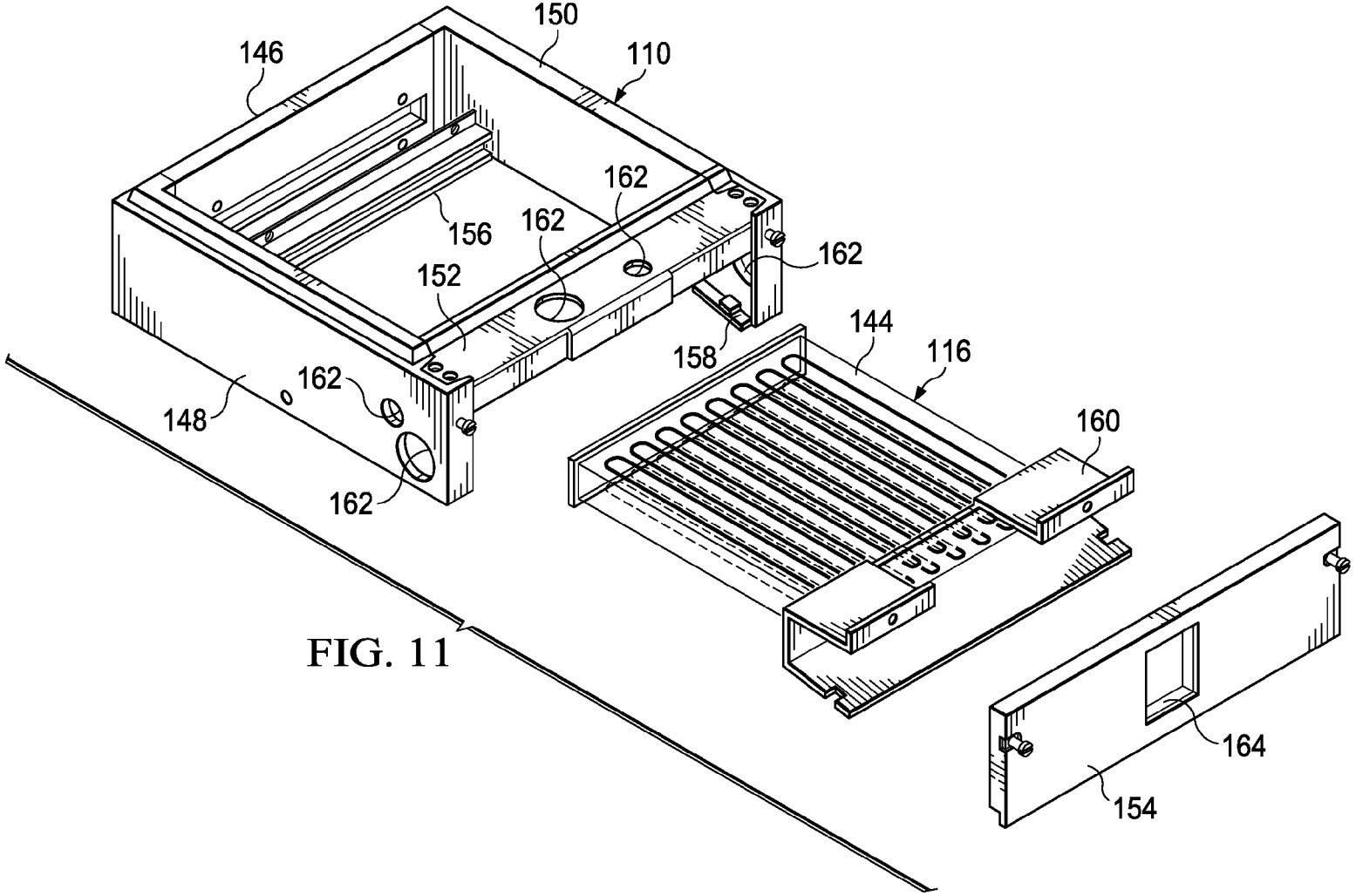
FIG. 11 is a schematic view of an HVAC system comprising a multipurpose cabinet in a first configuration for a first type of AHTC according to another embodiment of the disclosure.

Referring now to FIG. 11, an exploded view of a multipurpose cabinet 110 configured in a first configuration for housing an AHTC 116 comprising an HHE 144 is shown. In some embodiments, the multipurpose cabinet 110 may generally comprise a rear wall 146, a left wall 148, a right wall 150, a top crossbar 152, and a removable front cover 154. As configured for housing the AHTC 116 comprising the HHE 144, the multipurpose cabinet 110 may further comprise an HHE backing plate 156 that may be offset from the rear wall 146 and extends between the left wall 148 and the right wall 150. The HHE backing plate 156 may be configured to receive and selectively spatially constrain a rear portion of the HHE 144 when the HHE 144 is inserted into the multipurpose cabinet 110. The HHE 144 may be inserted and/or removed from the multipurpose cabinet 110 using a forward and/or rearward sliding motion. In some embodiments, the multipurpose cabinet 110 may comprise one or more shelves 158 formed in and/or carried on a forward portion of the left wall 148 and/or on a forward portion of the right wall 150. The shelves 158 may be sized and shaped to receive a complementary shaped portion of an AHTC front mounting bracket 160.

The AHTC 116 comprising the HHE 144 may be installed into the multipurpose cabinet 110 by sliding the AHTC 116 into the multipurpose cabinet until a rear portion of the AHTC 116 engages and/or is spatially constrained by the HHE backing plate 156 and the AHTC front mounting bracket 160 engages and/or is spatially constrained by the one or more shelves 158. After such insertion, the water inlet line 140 and water outlet line 142 may be passed through access aperture 164 of the front cover 154 and the lines 140, 142 may be joined to the HHE. Additionally, electrical wires and/or conduit may be passed through holes 162 of the multipurpose cabinet 110. Depending on the orientation of the multipurpose cabinet 110 relative to its surroundings, the holes 162 of the left wall 148, the right wall 150, or the top crossbar 152 may be used to accept the electrical wires and/or conduit therethrough. After the inlet line 140 and the outlet line 142 are connected as described above, the front cover 154 may be assembled to the left wall 148 and the right wall 150.

Figure 12:
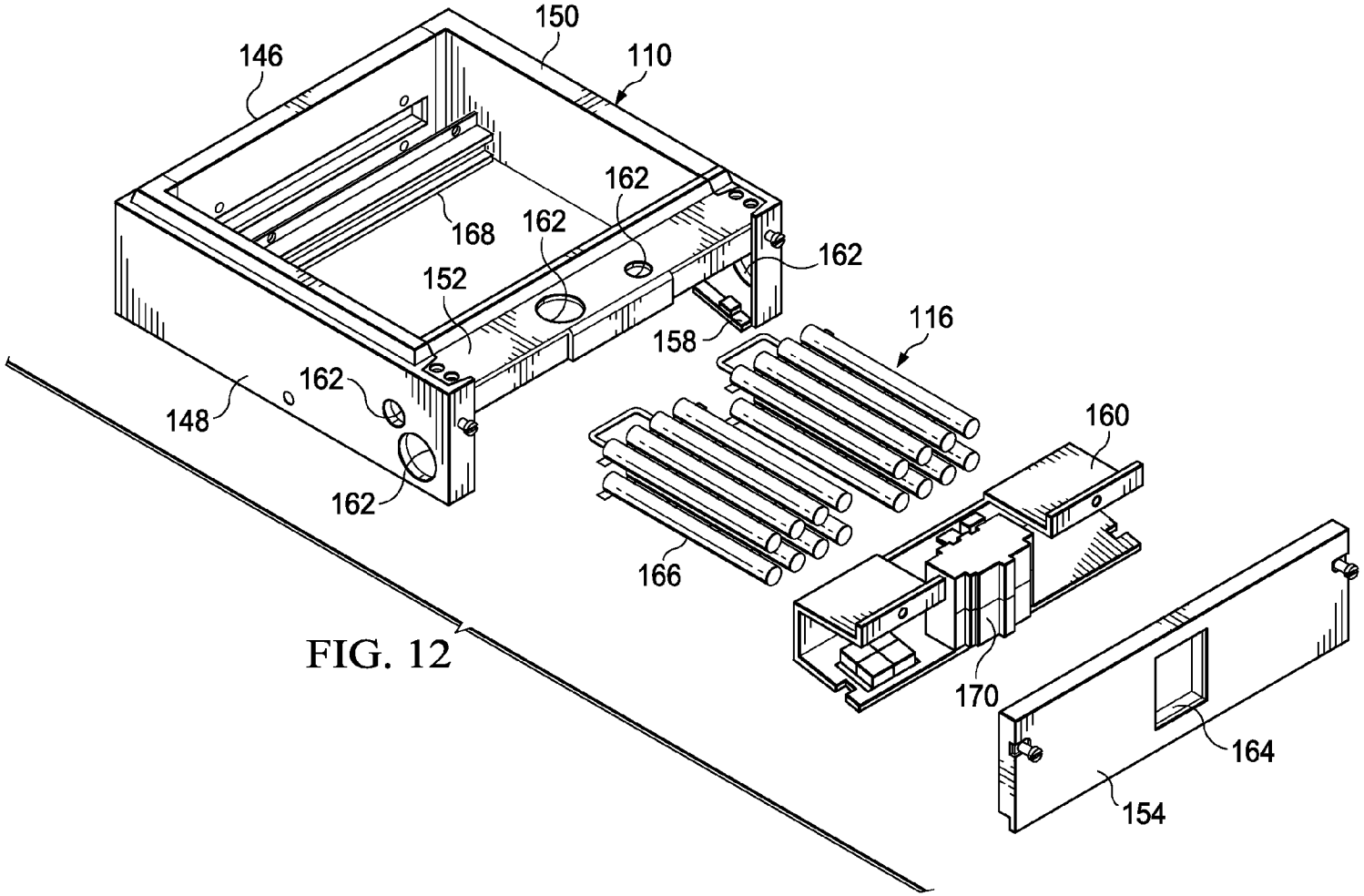
FIG. 12 is a schematic view of the HVAC system of FIG. 11 with the multipurpose cabinet in a second configuration for a second type of AHTC.

Referring now to FIG. 12, an exploded view of the multipurpose cabinet 110 configured in a second configuration for housing an AHTC 116 comprising an REHE 166 is shown. In this embodiment, the multipurpose cabinet 110 may be substantially similar to the configuration shown in FIG. 11. However, as configured in the second configuration for receiving an REHE 166, the multipurpose cabinet 110 may not comprise the HHE backing plate 156, but rather, may comprise a REHE backing plate 168 that may be shaped and sized complementary to a back portion of the REHE 166. Also, the REHE backing plate 168 may be located a different offset distance from the rear wall 146 in order to accommodate any difference in depth between the HHE 144 and the REHE 166. In some embodiments, the HHE backing plate 156 and the REHE 168 backing plate may be formed as a single backing plate that may be selectively installed in at least one of a different location and a different orientation as needed to selectively accommodate the HHE 144 or the REHE 166.

In some embodiments, the AHTC 116 comprising the REHE 166 may be installed into the multipurpose cabinet 110 by sliding the AHTC 116 into the multipurpose cabinet 110 until a rear portion of the AHTC 116 engages and/or is spatially constrained by the REHE backing plate 168 and the AHTC front mounting bracket 160 engages and/or is spatially constrained by the one or more shelves 158. After such insertion, electrical wires may be passed through holes 162 and connected to the REHE 166 and electrical components may be carried within a concavity of the AHTC front mounting bracket 160. In this second configuration, a front portion of a breaker 170 associated with the REHE 166 may be allowed to protrude at least partially into the access aperture 164 of the front cover 154, thereby allowing convenient access to the breaker 170. In some embodiments, the AHTC front mounting bracket 160 may serve as a baffle to prevent air leakage from the multifunction cabinet 110.

Figure 13:
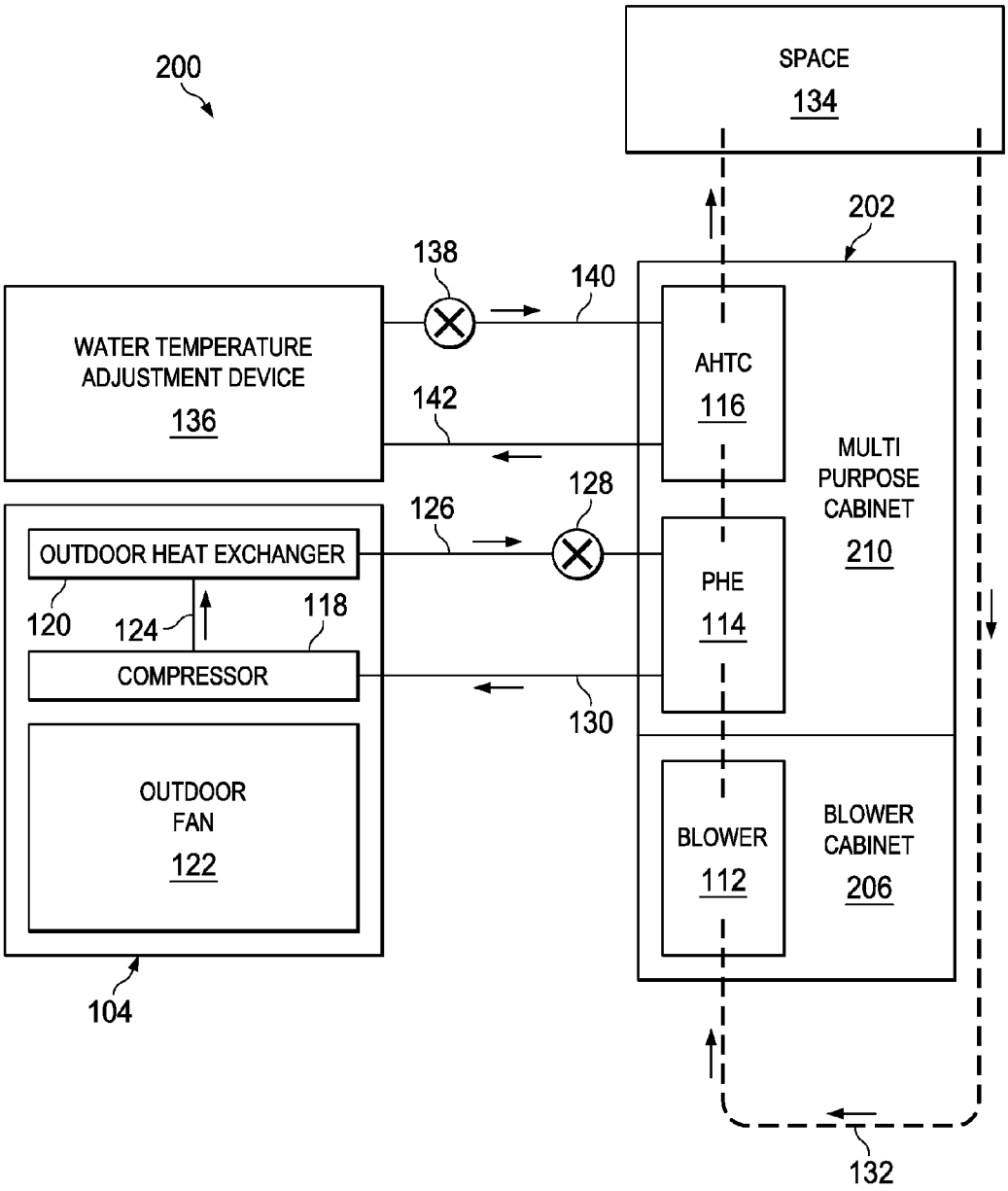
FIG. 13 is a schematic view of an HVAC system comprising a multipurpose cabinet for an AHTC according to another embodiment of the disclosure.

Referring now to FIG. 13, an HVAC system 200 is shown. HVAC system 200 is substantially similar to HVAC system 100 as shown in FIG. 1. However, HVAC system 200 differs from HVAC system 100 because rather than AHU 202 comprising a blower cabinet, a primary heat exchanger cabinet, and a multipurpose cabinet, the AHU 202 comprises a blower cabinet 206 configured to house a blower 212 and a multipurpose cabinet 210 that is configured to house each of a PHE 114 and an AHTC 116. In some embodiments, the blower cabinet 206 may be selectively removable from the multipurpose cabinet 210. It will be appreciated that the multipurpose cabinet 210 may, in alternative configurations of HVAC system 200, be located at various other locations along airflow path 132.

Figure 14:
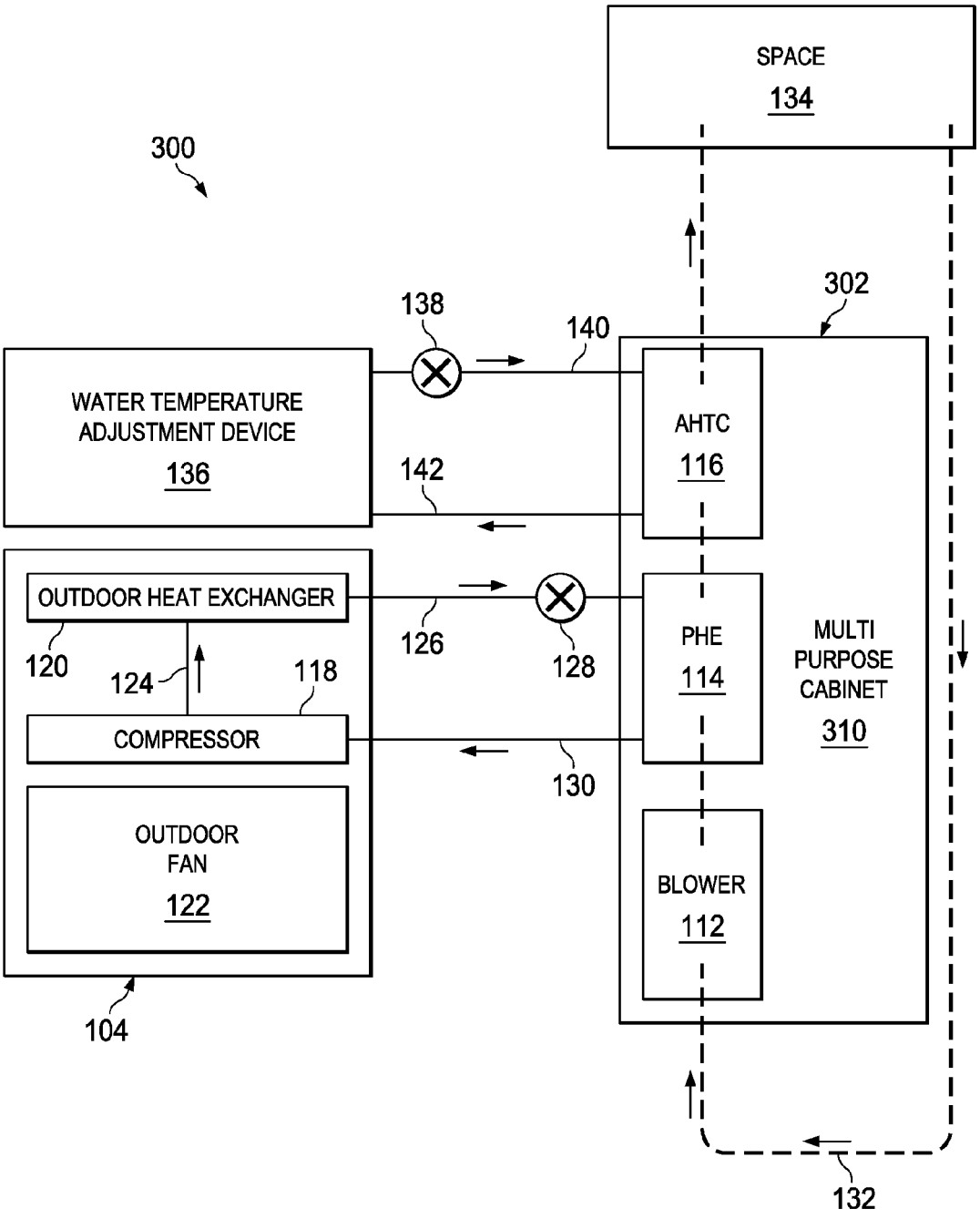
FIG. 14 is a schematic view of an HVAC system comprising a multipurpose cabinet for an AHTC according to another embodiment of the disclosure.

Referring now to FIG. 14, an HVAC system 300 is shown. HVAC system 300 is substantially similar to HVAC system 100 as shown in FIG. 1. However, HVAC system 300 differs from HVAC system 100 because rather than AHU 302 comprising a blower cabinet, a primary heat exchanger cabinet, and a multipurpose cabinet, the AHU 302 comprises a multipurpose cabinet 310 that is configured to house each of a blower 112, a PHE 114, and an AHTC 116.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, RI, and an upper limit, Ru, is disclosed, any number falling within the range is specifically disclosed. In particular, the following numbers within the range are specifically disclosed: R=RI+k * (Ru−RI), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A heating, ventilation, and/or air conditioning (HVAC) system, comprising:

an airflow path;

a primary heat exchanger disposed along the airflow path, wherein the airflow path at least partially passes through the primary heat exchanger; and a multipurpose cabinet comprising a removable front mounting bracket comprising a substantially flat bottom portion that comprises a notch disposed in the substantially flat bottom portion, wherein the multipurpose cabinet is selectively configurable for housing a hydronic heat exchanger type of auxiliary heat transfer component carried by the removable front mounting bracket and a rear mounting bracket disposed at a first offset distance from a rear wall of the multipurpose cabinet, wherein the airflow path at least partially passes through the multipurpose cabinet, and wherein the removable front mounting bracket is slidably received within the multipurpose cabinet in a rearward sliding direction and removed from the multipurpose cabinet in a forward sliding direction;

wherein the multipurpose cabinet comprises at least one shelf comprising a raised tab that extends from the shelf, wherein the raised tab is shaped complementary to the notch of the removable front mounting bracket, wherein the raised tab of the at least one shelf is configured to engage the notch of the removable front mounting bracket and spatially constrain the removable front mounting bracket to substantially restrict movement of the removable front mounting bracket in the forward sliding direction, and wherein the multipurpose cabinet is void of supports between the at least one shelf that extends only partially toward the rear wall of the multipurpose cabinet such that the hydronic heat exchanger type of auxiliary heat transfer component is carried only by (1) engagement of the removable front mounting bracket with the at least one shelf and (2) the rear mounting bracket.

2. The HVAC system according to claim 1, wherein the multipurpose cabinet is configurable in a second configuration to house a resistive electrical heat element type of auxiliary heat transfer component carried by the removable front mounting bracket and the rear mounting bracket disposed at a second offset distance from the rear wall of the multipurpose cabinet that is different from the first offset distance from the rear wall of the multipurpose cabinet.

3. The HVAC system according to claim 2, wherein the multipurpose cabinet is disposed downstream along the airflow path relative to the primary heat exchanger.

4. The HVAC system according to claim 2, the HVAC system further comprising:

an air handling unit comprising a primary heat exchanger cabinet that houses the primary heat exchanger and a blower cabinet that houses a blower, wherein the airflow path at least partially extends through the primary heat exchanger within the primary heat exchanger cabinet and the airflow path at least partially extends through the blower within the blower cabinet.

5. The HVAC system according to claim 2, wherein the multipurpose cabinet comprises a front cover having an access aperture, wherein the access aperture is configured to receive at least one of a water inlet line and a water outlet line therethrough when the multipurpose cabinet is configured for housing the hydronic heat exchanger type of auxiliary heat transfer component, and wherein the access aperture is configured to receive, to the exclusion of the at least one of the water inlet line and the water outlet line, an electrical component operably associated with the resistive electrical heat element type of auxiliary heat transfer component when the multipurpose cabinet is configured in the second configuration.

6. The HVAC system according to claim 1, wherein the multipurpose cabinet is further configured to house at least one of the primary heat exchanger and a blower.

7. The HVAC system according to claim 1, wherein the removable front mounting bracket comprises a baffle configured to prevent air leakage from the multipurpose cabinet.

* * * * *